United States Patent [19]

Fleet et al.

[11] Patent Number: 4,537,594

[45] Date of Patent: Aug. 27, 1985

[54] PROCESSED FEATHERS

[75] Inventors: Charles R. W. Fleet; Vincent K. Hewinson, both of Boston, England

[73] Assignee: Fogarty P.L.C., Lincolnshire, England

[21] Appl. No.: 630,763

[22] Filed: Jul. 13, 1984

[30] Foreign Application Priority Data

Jul. 22, 1983 [GB] United Kingdom ..... 8319816
Nov. 4, 1983 [GB] United Kingdom ..... 8329538

[51] Int. Cl.[3] ..... D06M 19/00
[52] U.S. Cl. ..... 8/94.1 R; 427/389
[58] Field of Search ..... 8/94.1 R; 427/389

[56] References Cited

U.S. PATENT DOCUMENTS 2,805,914 10/1957 Frederick et al. ..... 8/94.1 R
3,684,796 8/1972 Scherer et al. ..... 8/94.1 R
4,169,706 10/1979 Kruchen ..... 8/94.1 R
4,382,798 5/1983 Suzuki et al. ..... 8/94.1 R

FOREIGN PATENT DOCUMENTS 2659794 7/1978 Fed. Rep. of Germany .... 8/94.1 R

*Primary Examiner*—Paul Lieberman
*Assistant Examiner*—Willie Thompson
*Attorney, Agent, or Firm*—Watson, Cole, Grindle & Watson

[57] ABSTRACT

Feathers (including down) are provided with a water-repellant, bacterial-resistant, low friction cured fluorocarbon finish, such that the feathers have improved driability following washing and enhanced handle and resistance to clumping. The finished feathers are used in filled articles, such as quilts or pillows, which have enhanced washability.

9 Claims, No Drawings

PROCESSED FEATHERS

The present invention is concerned with processed feathers which can be used as filling in washable filled articles such as pillows and quilts, the term "feathers" encompassing feathers and/or down.

Certain methods of water-resistant finishing of feathers have been known for many years. For example, a process known as the "Tan-O-Quil" process was developed in the 1950's on behalf of the U.S. Government; this process involves tanning the feathers with a chromium salt in hot water. While this process does impart a degree of water-resistance to the feathers, they have poor handle, and the process involves effluent problems and attack on equipment by the aggressive chemicals used.

A more recent development is a process known as the "Aversin" process developed by Henkel GmbH, which also involves tanning with a chromium compound and the use of a mordant. This process still involves effluent problems, the treated feathers still have poor handle, and there is still the problem that aggressive chemicals are used which must be stored in the absence of air, are inflammable and noxious.

A method of treating feathers so as to give them improved hygienic properties for use as fillings for washable cushions, quilts, sleeping bags and the like has also been proposed in German Auslegeschrift No. 2228491. The method of treatment described, which is known as the "Nocar" process, involves treatment with an aluminium salt of a lower fatty acid (such as $Al(OH)_2OOCCH_3$), followed by thermal treatment at a temperature of greater than 100° C.

Thus the tendency in the art has been to use inorganic materials rather than polymers for treating feathers.

We have now developed an improved water-resistant finish for feathers. The invention accordingly provides feathers having thereon a water-repellant, bacterial-resistant, low friction cured fluorocarbon polymer finish which is such that the finished feathers have improved driability following washing and enhanced handle and resistance to clumping. This resistance reduces the risk of odour development in incompletely dried feathers. Feathers according to the invention may also have improved fill-power (bulk) and soil resistance.

The low friction fluorocarbon polymer finish may be, for example, of a curable fluorocarbon polymer (such as a tetrafluorethylene polymer or a fluoroalkyl acrylate copolymer). A particularly suitable polymer is available from Rudolf Chemie GmbH as Rucapol FFF.

An advantage of the application of a fluorocarbon polymer finish to feathers, as compared with tanning, is that there is no need to use a two-stage process involving hazardous or noxious chemicals (with consequently less hazards to operatives and less problems with effluent); the use of less aggressive chemicals ensures that attack on the equipment used is also minimised.

Several polymers might be considered for imparting water-repellent low friction polymer finishes to feathers, among which are silicones (which have been proposed as finishes for feathers in German Auslegeschrift No. 2659794).

We have surprisingly found that a balanced combination of a high degree of water repellency, stain- and oil-resistance, retention of neutral handle and resistance to bacterial attack essential to sound prolonged product performance of feather-filled articles is better provided by a fluorocarbon finish. We have also found that bacteriostats can be advantageously applied with the fluorocarbon finish.

Apart from enhanced final product performance there are advantageous process features. Some silicone hydrophobic type finishes can be unstable in application on process plant, have limited "batch-life", and do not lend themselves to the standing-bath technique.

Work has additionally shown that they do not readily exhaust onto feathers either at ambient or elevated temperatures. By way of contrast, we have found that one part fluorocarbon polymer emulsions have prolonged "batch-life" so that the standing-bath technique can be employed. We have also established that they can be applied to feathers by the exhaust technique at ambient and at elevated temperatures (typically 30°–60° C., for example 30°–40° C.). This is notable and at variance with experience in other areas, typically textiles where fabrics (yarns) cannot generally be finished by fluorocarbon polymers by exhaustion, so that the standing-bath technique (roller-pad application) has to be employed instead.

The application liquor may be prepared from an aqueous emulsion which is stable at 10–40% solids, the emulsion typically containing a cationic emulsifier. Depending upon whether the mode of application is by the standing-bath technique, the exhaustion method or spraying, the emulsion is diluted to give concentrations in the range 1 g/l to 50 g/l on weight of emulsion to realise between 0.1 to 15% (e.g. 0.3% to 10%) by weight dry solid add-on to the feathers.

To ensure consistent and effective application onto the feathers, and consequently optimum final product performance, the feathers should undergo an efficient cleansing process prior to application of the fluorocarbon.

When necessary, the feathers may be first "dusted" to remove any particulate contamination prior to a thorough aqueous, solvent or combined wash. The equipment for the washing process should provide vigorous physical action and good feather separation employing liquor to feather ratios of 10 to 40:1, such as 10 to 20:1. A washing agent may be used for aqueous washing, the washing temperature being typically 40° C. One or more wash cycles may be used, depending upon the fat and wax content of the feathers and amount of dirt present. Subsequent rinses should be sufficient to remove residual surfactant, dirt particles and released matter. Finally, a centrifuge or other method, may be used to remove water leaving approximately 25–45% of moisture in the feathers (on dry weight). This level is suitable for subsequent application of fluorocarbon finish by the standing-bath or exhaust method. If a batch process is employed and the feathers are first dried and stored they may be loaded to the application plant in the dry state and no prior wetting-out is necessary; application and subsequent product performance is not affected. If application of fluorocarbon finish by the spray method is to be employed, however, performance is enhanced when feathers are used at 5–15% moisture content.

The standing-bath and exhaustion techniques have been used with liquor to feather ratios of approximately 10 to 1 and 20 to 1 for Down, Feathers and blends of Feather and Down. In both these methods the pH of the liquor may be adjusted to between 4.5 and 5.0 with an easily volatilised acid, such as acetic. The standing-bath technique may use a concentration of 20 to 50 g/l of pre-emulsified, fluorocarbon. The exhaust technique may use a concentration of between 1 g/l to 10 g/l. In each case the treatment may be applied at ambient or elevated temperatures, for example 40° C., for, say, 15 to 45 minutes. Constant agitation of the bath is preferred to ensure a completely even application of the fluorocarbon to the extremely extended and complex surface of the feathers. After treatment, standing-bath liquor may be reclaimed for re-use, after refortification with polymer. The exhaust bath consequently depleted of chemical, may be drained to waste. Subsequent partial drying by centrifuge, or other method, should leave 25–45% of moisture on the feather.

Final drying of the feather, and curing of the fluorocarbon may then be carried out. These can be effected in one combined stage, or two separate operations. Curing is preferably at not less than 60° C. (for example, 60°–200° C.); when the finish is curable at elevated temperature, it is preferred to cure it at a relatively high temperature (such as 130° C. to 170° C., for example, about 150° C. in some cases), such that the finish is firmly bonded to the feathers and any bacteria present can be destroyed. In general, the higher the temperature employed, the shorter is the time required. At 150° C. we have employed a curing time of 6 minutes. Lower temperatures can be used but, in the case of high temperature curable material, this may involve a time penalty (a longer curing time) and some loss of fastness. The higher temperatures are not usually employed in the treatment of feathers, but when employed in a plant which provides rapid air change with thorough opening of individual feathers treated with fluorocarbon polymer, no adverse effects are found. Indeed, the development of good feather bulk (fill power) occurs under conditions where pre-heated air enters the drying/curing chamber and passes upwards, through mechanically agitated feathers.

As indicated, feathers or down having a fluorocarbon finish are washable; they may be washed (when present in a quilt or pillow) in a conventional washing machine, like pillows or quilts having synthetic fillings. For example, in a standard test, a quilt filled with untreated feathers had a drying time of 70 minutes, whereas a similar quilt filled with feathers having a cured fluorocarbon finish had a drying time of only 35 minutes, which is equivalent to the drying time of a polyester-filled quilt. (This compares with a drying time of 55 minutes for a quilt filled with chrome-tanned feathers according to either the Tan-O-Quil process or the Aversin process).

In low density articles (such as quilts or pillows) filled with feathers according to the invention, it appears that the low surface friction imparted by the fluorocarbon polymer finish may assist drying by facilitating relative movement of feathers (or parts of feathers) and allowing enhanced air-flow through the filling.

It is important that feathers present in washed pillows or quilts should dry thoroughly and preferably quickly, as with damp feathers there is the serious potential problem of bacterial and fungal attack, physical breakdown and odour development.

When a very high level of bacterial resistance is desired a bacteriostat may be applied together with the fluorocarbon in one bath at a level to give between 1% and 5% add-on by dry weight.

The following Example is given by way of illustration only.

EXAMPLE

A 70 kg load of White Goose Down was processed by the following procedure using an automatic horizontal centrifugal washing and extraction machine fed from a silo. The treatment liquor was prepared from fluorocarbon emulsion to a concentration of 3 g/l (on weight of emulsion).

Card 1

(a) Charge from silo
(b) Fill with water, raise temperature to 40° C. and add ½ liter of Rucogen HLK
(c) Wash for 10 minutes, drain, predry
(d) Rinse 5 minutes cold, drain, predry
(e) Rinse 5 minutes cold, drain, predry
(f) Centrifuge
(g) Rinse 5 minutes cold, drain, predry
(h) Centrifuge, steam loosen, centrifuge

Card 2

(a) Fill the treatment liquor from Chemical Holding Tank
(b) Treat cold, rotating alternately for 20 minutes
(c) Drain and predry
(d) Centrifuge
(e) Steam loosen
(f) Centrifuge
(g) Discharge to silo The down in the discharge silo had a moisture take-up of 35%. This wet stock was fed to a hot-air vertical drying and curing unit in batches of 9 kg. The treatment lasted for 30 minutes during which time the temperature in the unit rose steadily from approximately 120° C., immediately after inserting the charge, until it reached and maintained 150° C. for the final 6 minutes.

After discharge from the curing unit, the down was transported in a pneumatic duct system to a cooling unit. The down temperature was reduced to approximately 25° C. within 5 minutes and then bagged-up.

Pillows and quilts were produced from this material to the following specification.

Pillows

Down filling weight 510 gm
Fabric cover type, 100% cotton sateen, 212 g/m$^2$
Dimensions 74 cm×48 cm

Quilts

Down filling weight total 720 gm (120 gm per channel)
Fabric cover type, 100% Cotton Downproof Cambric, 130 g/m$^2$
Dimensions 137 cm×200 cm Test results on the treated and untreated down gave the following:

| | % WATER RETENTION | WETTING RATIO |
|---|---|---|
| TREATED | 15 | 1.4 |
| UNTREATED | 58 | 12.6 |

A pillow and quilt produced from treated and untreated down were washed in a laundrette washing machine at 40° C. and then given a 3 minute approx. 1400 rpm spindry before final tumble drying. They were each removed from the tumble dryer at intervals and weighed. Tumble drying was continued until the products returned to their original dry weight.

The pillow filled with untreated down took 60 minutes compared with 30 minutes for treated down while the quilt comparisons were 30 minutes against 15 minutes.

cated by a zero negative volume percentage and a 100% positive value.)

The following table shows that adequately water-repellent feathers exhibit a good positive volume % on the fourth cycle, with a small difference between this and the first cycle value.

| | | | 1st Cycle | | 2nd Cycle | | 3rd Cycle | | 4th Cycle | |
|---|---|---|---|---|---|---|---|---|---|---|
| | | | +'ve % | −'ve % | +'ve % | −'ve % | +'ve % | −'ve % | +'ve % | −'ve % |
| (A) | Standard untreated | 1. Unwashed | 75 | 25 | 25 | 75 | 5 | 95 | 0 | 100 |
| | feather | 2. Washed | 55 | 45 | 25 | 75 | 5 | 95 | 0 | 100 |
| (B) | Optimised process for | 1. Unwashed | 88 | 12 | 78 | 22 | 40 | 60 | 25 | 75 |
| | Silicone finish | 2. Washed | 60 | 40 | 35 | 65 | 8 | 92 | 0 | 100 |
| (C) | Optimised process for | 1. Unwashed | 100 | 0 | 92 | 8 | 75 | 25 | 70 | 30 |
| | Fluorocarbon finish | 2. Washed | 95 | 5 | 72 | 28 | 60 | 40 | 50 | 50 |

Comparison of Fluorocarbon-finished Feathers and Silicone-finished Feathers

A 5 gram sample of feathers (including down) was gently placed in a 2 liter measuring cylinder, the cylinder being tilted to an angle of 45° C. from the vertical followed by pouring one liter of water carefully down the cylinder wall. The cylinder was then returned to the vertical and sealed with a rubber stopper. The following sequence was then carried out:

1. Tilt the cylinder to 45° to the vertical.
2. Rotate the cylinder 90° through the horizontal and then return to starting position; 1 agitation.
3. Repeat four times making 5 agitations in all; 1 cycle.
4. Return cylinder to upright, remove the stopper and wait 30 seconds.
5. Read the height x, in cubic centimeters, of the feathers above the water-line (judging the best mean horizontal level of the uneven surface) and depth, y, below the water-line.
6. Repeat steps 3–8 until readings for four cycles are obtained.

The results are expressed as percentages in the following table, the percentages being calculated as follows:

Positive % volume (above water-line) $\frac{x}{x+y} \times 100\%$

Negative % volume (below water-line) $\frac{y}{x+y} \times 100\%$ (Untreated feathers generally become totally submerged; that is, the negative volume is 100%. Conversely an ideally water-repellent performance is indi-

What is claimed is:

1. Feathers having thereon a water-repellent, bacterial-resistant, low friction cured fluoroalkyl acrylate copolymer finish.

2. A method of treating feathers, which comprises applying to said feathers an aqueous emulsion of a curable fluoroalkyl acrylate copolymer, and curing said polymer.

3. A method according to claim 2, in which said emulsion is applied by exhaustion.

4. A method according to claim 2, in which said feathers are thoroughly cleansed prior to application of said copolymer.

5. A method according to claim 4, in which said cleansing is by means of a water wash, followed by partial water removal so as to leave a residual moisture content of 5 to 45% based on the weight of completely dry feathers.

6. A method according to claim 2, in which said copolymer is cured at 130° to 170° C.

7. A method of treating feathers, which comprises applying to said feathers an aqueous emulsion of a curable fluoroalkyl acrylate copolymer and curing said polymer at 130° to 170° C.

8. A filled article, which comprises a fabric casing having a filling comprising feathers having thereon a water repellant, bacterial resistant, low friction cured fluoroalkyl acrylate copolymer finish.

9. A filled article, which comprises a casing having a filling comprising feathers treated by applying to said feathers an aqueous emulsion of a curable fluroalkyl acrylate copolymer, which is then cured.

* * * * *